US005526104A

United States Patent [19]

Kawano

[11] Patent Number: 5,526,104

[45] Date of Patent: Jun. 11, 1996

[54] IMAGE FORMING APPARATUS WITH IMPROVED MANUAL PAPER FEED INLET

[75] Inventor: Yuzo Kawano, Ogori, Japan

[73] Assignee: Matsushita Electric Industrial Co., Ltd., Osaka, Japan

[21] Appl. No.: 413,011

[22] Filed: Mar. 29, 1995

[30] Foreign Application Priority Data

Mar. 29, 1994 [JP] Japan ..... 6-058658
Jun. 14, 1994 [JP] Japan ..... 6-130717

[51] Int. Cl.[6] ..... G03G 15/00

[52] U.S. Cl. ..... 355/308; 347/139; 347/153; 271/3.01; 271/9.09

[58] Field of Search ..... 355/308, 309, 355/319, 321; 271/3.01, 9.09; 347/138, 139, 152, 153; 400/599

[56] References Cited

U.S. PATENT DOCUMENTS 5,086,320 2/1992 Koike ..... 35/308 X
5,168,316 12/1992 Hino et al. ..... 355/309
5,203,552 4/1993 Hoshi et al. ..... 271/9.09
5,347,349 9/1994 Sato et al. ..... 355/309

*Primary Examiner*—Joan H. Pendegrass
*Assistant Examiner*—Sophia S. Chen
*Attorney, Agent, or Firm*—Lowe, Price, LeBlanc & Becker

[57] ABSTRACT

An image forming apparatus is provided which includes a recording sheet ejection outlet, an ejected recording sheet tray, and a manual recording sheet feed inlet. The recording sheet ejection outlet is formed in an end portion of an upper surface of a casing. The ejected recording sheet tray is provided adjacent the recording sheet ejection outlet. The manual recording sheet feed inlet is formed in the other end portion of the upper surface of the casing opposite the recording sheet ejection outlet across the ejected recording sheet tray so as to utilize the ejected recording sheet tray as a recording sheet feed tray for insertion of a recording sheet into the manual recording sheet feed inlet.

9 Claims, 7 Drawing Sheets

IMAGE FORMING APPARATUS WITH IMPROVED MANUAL PAPER FEED INLET

BACKGROUND OF THE INVENTION

1. Technical Field

The present invention relates generally to an image forming apparatus having an improved structure wherein a manual paper feed inlet is formed in an upper surface of a casing in addition to a recording sheet storage cassette.

2. Background Art

In recent years, there have been proposed image forming apparatuses such as a copying or printing machine which have either a cassette paper feed system for feeding a recording paper sheet from a paper cassette or a manual paper feed system not using a paper cassette.

Hereinafter, an example of a conventional image forming apparatus will be described with reference to FIGS. 6 and 7.

The shown image forming apparatus includes a photosensitive medium 2, an electrifier 4, an exposure optical system 5, a developing roller 6, a transfer roller 7, and a cleaning blade 8.

The photosensitive medium 2 is formed with a thin film, made of selecium (Se) or organic photoconductive (POC) materials, applied on an outer peripheral surface of a drum which is rotatably supported by a shaft 3 mounted on a side wall of a process unit 1. The electrifier 4 is connected to a high voltage power supply (not shown), and includes an electrifying blush **4*a* made of conductive rayon and an electrifying plate 4*b* made of a metallic plate. Applying a high voltage on the order of 1.2 kV to the electrifying plate 4*b* causes the electrifying bush 4*a* to discharge so that the photosensitive medium 2 is charged uniformly. The exposure optical system 5 emits an exposure beam 5*a* onto the photosensitive medium 2 to form electrostatic latent images according to image signals. The developing roller 6 is composed of a conductive member 6*b* made of urethane formed around a developing roller shaft 6*a*, and is supported rotatably on the side wall of the process unit 1. Similarly, the transfer roller 7 includes a conductive member 7*b* made of urethane formed on an outer peripheral surface of a transfer roller shaft 7*a* rotatably supported on the side wall of the process unit 1. The cleaning blade 8 serves to remove unnecessary toner left on the photosensitive medium 2**.

A transfer paper cassette 9 storing therein a stack of sheets of transfer sheet 10 is disposed on the bottom of the image-forming apparatus. The transfer sheet 10 is fed by a paper pickup roller 11, in sequence, to a transfer sheet feeding path 13 through a nip formed between the paper pickup roller 11 and a feeding roller 12. A manual paper feed inlet 14 is formed in an end wall of a casing 50. When an operator inserts the transfer sheet 15 into the manual paper feed inlet 14 from the direction B, as shown in FIG. 6, it is fed under feeding pressure exerted by the paper pickup roller 11 and the feeding roller 12 toward the transfer sheet feeding path 13.

The image forming apparatus further includes a registry arm 17, a fixing device 18, and a selector member 21. The registry arm 17 is provided to bring the transfer sheet 15 into registration with toner images formed on the photosensitive medium 2. The fixing device 18 is composed of a heat roller 19 incorporating therein a heat source and a pressure roller 20. The heat roller 19 engages the pressure roller 20 to form a nip through which the transfer sheet 10 passes under heat and pressure for fixing the toner images transferred on the transfer sheet 10. The selector member 21 is pivotably mounted to assume two positions: a face-up feed position, as indicated by a broken line, and a face-down feed position, as indicated by a solid line. The selector member 21 feeds, in the face-down feed position, the transfer sheet 10 toward face-down rollers 22, while it feeds the transfer sheet 10 toward face-up rollers 23 in the face-up feed position.

In operation, a high voltage of the order of −1.2 kV is first applied to the electrifier 4 through the high voltage power supply to uniformly charge the surface of the photosensitive medium 2 rotating in the direction, as indicated by an arrow in FIG. 7, at a voltage on the order of −700 V. The exposure beam **5*a* in the form of a laser beam is then radiated according to image data onto the charged surface of the photosensitive medium 2 to form electrostatic latent images thereon. The timing to start forming the electrostatic latent images is determined based on a signal provided by the registry arm 17. Subsequently, a negative voltage of the order of −300 V is applied to toner deposited on the surface of the developing roller 6. This will cause the toner on the developing roller 6 to be transferred only to portions of the photosensitive medium 2 from which the charge is removed by the radiation of the exposure beam 5*a* to perform the development in the so-called negative-positive process. The transfer roller 7 is applied with a high voltage of the order of +1 kV to transfer the toner deposited on the photosensitive medium 2 to the surface of the transfer sheet 10 transported by the feeding roller 12**.

When the transfer sheet 15 is manually inserted into the manual paper feed inlet 14, it is transported to the transfer roller 7 according to rotation of the paper pickup roller 11 and the feeding roller 120 so that the toner deposited on the photosensitive medium 2 is transferred on the transfer sheet 15. The timing to start forming electrostatic latent images on the photosensitive medium 2 is, similar to the above, determined based on a signal provided by the registry arm 17. For stable feed of the transfer sheet 15, a manual paper feed tray 16 is provided on the side wall of the casing 10 for preventing the transfer sheet 15 from being inserted obliquely into the manual paper feed inlet 14. The unnecessary toner left on the photosensitive medium 2 without being transferred to the transfer sheet 10 or 15 is removed by the cleaning blade 8.

Afterwards, the toner image-transferred transfer sheet 10 or 15 is fed to the fixing device 18 wherein the toner images are fixed under heat of the heat roller 19 and pressure exerted by the pressure roller 20, after which it is directed by the selector member 21 to the face-up rollers 23 or the face-down rollers 22.

The above discussed prior art image forming apparatus has suffered from the following drawbacks. Usually, into the manual paper feed inlet 14, a special size of the transfer sheet 15 such as an OHP sheet, an envelope, or a transfer sheet for double side printing is manually inserted. Thus, for stable feed of the transfer sheet into the manual paper feed inlet 14, the manual paper feed tray 16 having a size enough to receive the transfer sheet 15 is needed. This, however, results in the overall structure of the image forming apparatus becoming bulky. Additionally, if the manual paper feed tray 16 having a size much smaller than that of the transfer sheet 15 for reduction in overall size of the apparatus, the transfer sheet 15 may be inserted obliquely into the manual paper feed inlet 14.

SUMMARY OF THE INVENTION

It is therefore a principal object of the present invention to avoid the disadvantages of the prior art.

It is another object of the present invention to provide an improved structure of an image forming apparatus which is designed to provide a manual paper feed inlet at a location where part of an upper wall of a casing may be utilized as a manual paper feed tray for stable insertion of different sizes of transfer sheets into the manual paper feed inlet.

According to one aspect of the present invention, there is provided an image forming apparatus which comprises a casing having an upper surface; an image recording means disposed within the casing to record an image on a recording medium; and a recording medium feed inlet formed in the upper surface of the casing for insertion of the recording medium into the casing.

In the preferred mode of the invention, the casing has a flat surface formed on the upper surface leading to the recording medium feed inlet. A guide member is further provided on the flat surface for guiding insertion of the recording medium into the recording medium feed inlet.

A second recording medium feed inlet is further formed in a side wall of the casing.

According to another aspect of the invention, there is provided an image forming apparatus which comprises a casing having an upper surface which has a first end portion and a second end portion opposite the first end portion; an image recording means disposed within the casing to record an image on a recording medium; a recording medium ejection outlet formed in the first end portion of the casing for ejecting the recording medium on which the image is recorded by the image recording means out of the casing; an ejected recording medium receiving portion formed on the upper surface of the casing between the first and second end portions for receiving the recording medium ejected from the recording medium ejection outlet; and a recording medium feed inlet formed in the second end portion of the casing for insertion of the recording medium into the casing.

In the preferred mode of the invention, a cover is provided on the recording medium feed inlet to selectively assume a closing position for closing the recording medium feed inlet and an opening position for opening the recording medium feed inlet.

According to a further aspect of the invention, there is provided an image forming apparatus which comprises a casing having an upper surface which has a first end portion and a second end portion opposite the first end portion; an image recording means disposed within the casing to record an image on a recording medium; a recording medium ejection outlet formed in the first end portion of the casing for ejecting the recording medium on which the image is recorded by the image recording means out of the casing; and a recording medium feed inlet formed in the second end portion of the casing for insertion of the recording medium into the casing.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
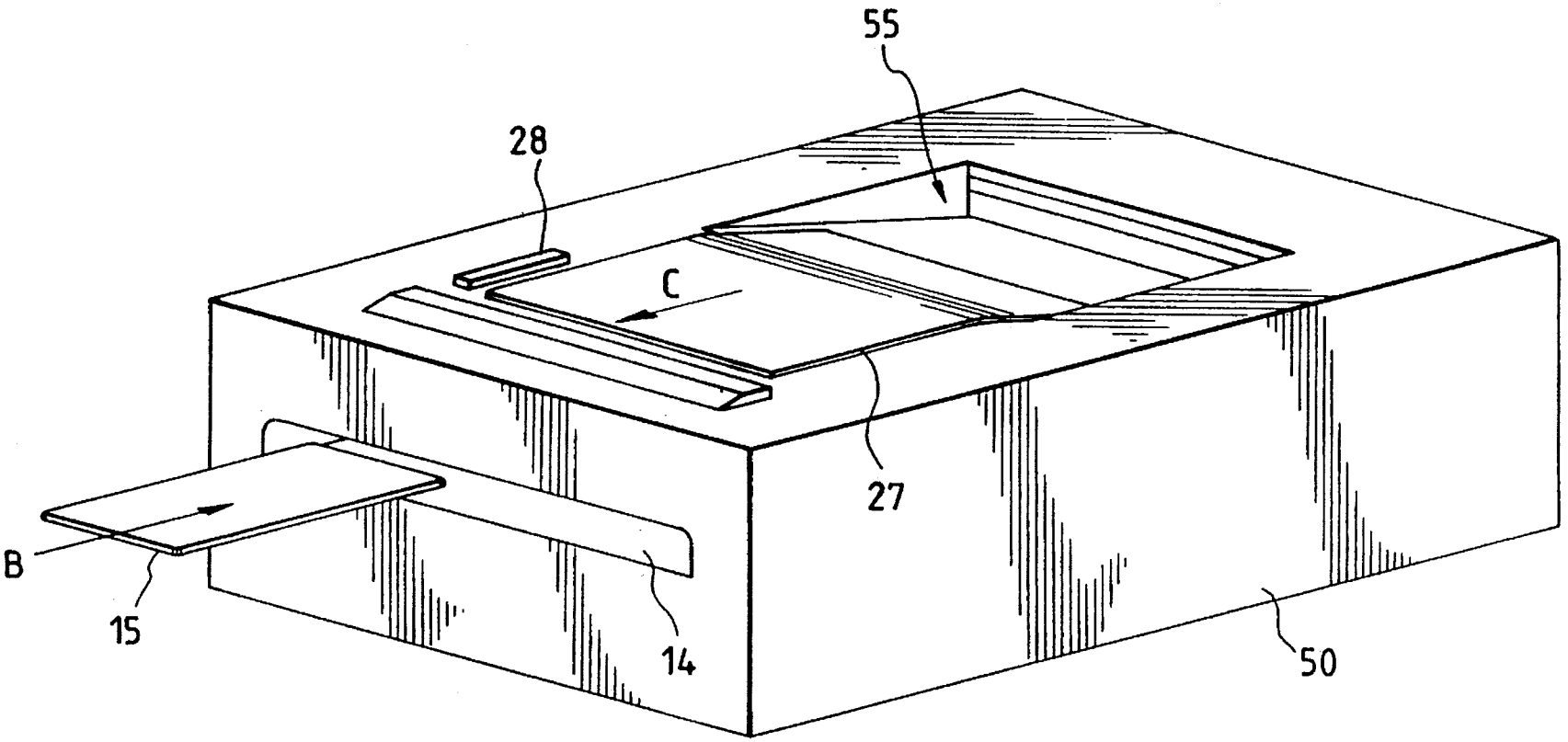
FIG. 1 is a perspective view which shows an image forming apparatus according to the present invention.
Figure 2:
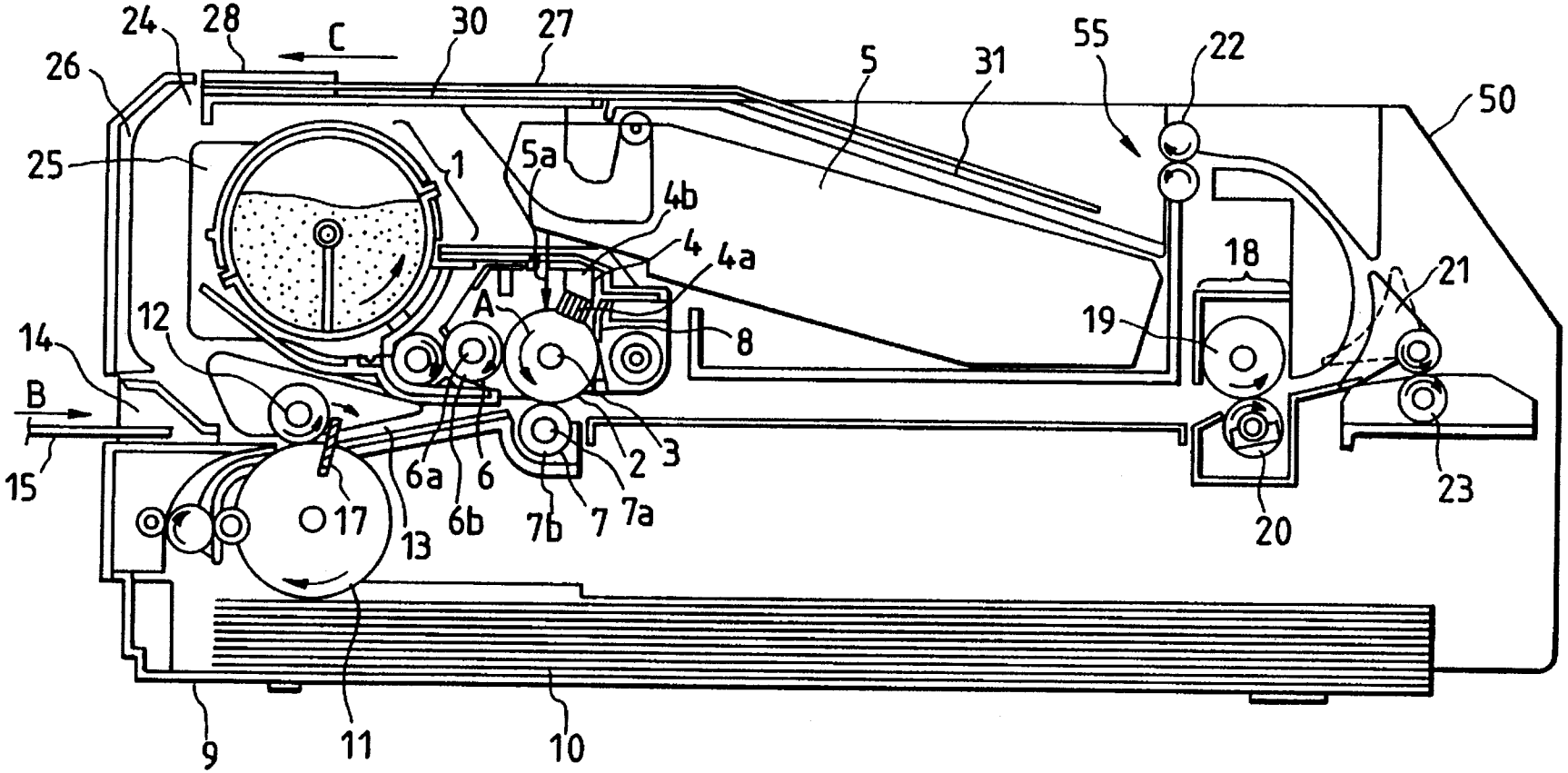
FIG. 2 is a cross sectional view which shows an image forming apparatus of the invention.

Referring now to the drawings, particularly to FIGS. 1 and 2, there is shown an image forming apparatus according to the present invention which may be employed as a printer or a copying machine.

The image forming apparatus includes generally a photosensitive medium 2, an electrifier 4, an exposure optical system 5, a developing roller 6, a transfer roller 7, and a cleaning blade 8.

The photosensitive medium 2 is formed with a thin film, made of selecium (Se) or organic photoconductive (POC) materials, applied on an outer peripheral surface of a drum which is rotatably supported by a shaft 3 mounted on a side wall of a process unit 1. The electrifier 4 is connected to a high voltage power supply (not shown), and includes an electrifying brush **4*a* made of conductive rayon and at, electrifying plate 4*b* made of a metallic plate. Applying a high voltage on the order of 1.2 kV to the electrifying plate 4*b* causes the electrifying brush 4*a* to discharge so that the photosensitive medium 2 is electrified uniformly. The exposure optical system 5 emits an exposure beam 5*a* onto the photosensitive medium 2 to form electrostatic latent images according to image signals. The developing roller 6 is composed of a conductive member 6*b* made of urethane formed around a developing roller shaft 6*a*, and is supported rotatably on the side wall of the process unit 1. Similarly, the transfer roller 7 includes a conductive member 7*b* made of urethane formed on an outer peripheral surface of a transfer roller shaft 7*a* rotatably supported on the side wall of the process unit 1. The cleaning blade 8 serves to remove unnecessary toner remaining on the photosensitive medium 2**.

A transfer paper cassette 9 storing therein a stack of sheets of transfer sheet 10 is disposed on the bottom of the image-forming apparatus. The transfer sheet 10 is fed by a paper pickup roller 11, in sequence, to a transfer sheet feeding path 13 through a nip formed between the paper pickup roller 11 and a feeding roller 12. A manual paper feed inlet 14 is formed in an end wall of a casing 50. When an operator inserts the transfer sheet 15 into the manual paper feed inlet 14 from the direction B, as shown in FIGS. 1 and 2, it is fed under feeding pressure exerted by the paper pickup roller 11 and the feeding roller 12 toward the transfer sheet feeding path 13.

The image forming apparatus further includes a registry arm 17, a fixing device 18, and a selector member 21. The registry arm 17 is provided to bring the transfer sheet 15 into registration with toner images formed on the photosensitive medium 2. The fixing device 18 is composed of a heat roller 19 incorporating therein a heat source and a pressure roller 20. The heat roller 19 engages the pressure roller 20 to form a nip through which the transfer sheet 10 passes under heat and pressure for fixing the toner images transferred on the transfer sheet 10. The selector member 21 is pivotably mounted to assume two positions: a face-up feed position, as indicated by a broken line, and a face-down feed position, as indicated by a solid line. The selector member 21 feeds, in the face-up feed position, the transfer sheet 10 toward face-down rollers 22, while it feeds, in the face-down feed position, the transfer sheet 10 toward face-up rollers 23.

An ejected paper outlet 55 is formed in the upper wall of the casing 50. The ejected paper outlet 55 includes a flat ejected paper tray 31 inclined at a given angle from art upper flat surface 30 of the casing to beneath the face-down rollers 22.

A second manual paper feed inlet 24 is formed in an end of the upper flat surface 30 at a location most away from the face-up rollers 22 in a lengthwise direction of the casing 50, and opens to the upper flat surface 30. Specifically, the second manual paper feed inlet 24 is formed in the end of the upper wall of the casing 50 so as to utilize the upper flat surface 30 and the ejected paper tray 31 as a transfer sheet-feeding tray on which the transfer sheet 27 is placed when inserted manually into the second manual paper feed inlet 24. These arrangements eliminate the need for an additional tray exclusively used for the transfer sheet 27. Thus, even when the transfer sheet 27 has a relatively large size, it can be inserted smoothly into the second manual paper feed inlet 24 without being folded undesirably. Additionally, when it is required to form images on both sides of the transfer sheet 27, the transfer sheet 27 which has been ejected on the ejected paper tray 31 after images are formed on its one side, can be reversed and slid manually along the upper flat surface 30 of the casing 50 into the second manual paper feed inlet 24 for a second image-forming process.

A guide 25 is mounted on the process unit 1, and defines a second transfer sheet feeding path 36 together with a guide 26 mounted on an inner wall of the casing 50 through which the second transfer sheet 27 passes. A paper insertion guide 28, as shown in FIG. 1, is attached to the upper wall of the casing 50 for orienting the insertion of the second transfer sheet 27.

In operation, a high voltage of the order of −1.2 kV is first applied to the electrifier 4 through the high voltage power supply to uniformly charge the surface of the photosensitive medium 2 rotating in the direction A, as shown in FIG. 2, at a voltage on the order of −700 V. The exposure beam **5*a* in the form of a laser beam is then radiated according to image data onto the charged surface of the photosensitive medium 2 to form electrostatic latent images thereon. The timing to start forming the electrostatic latent images is determined based on a signal provided by the registry arm 17**.

Subsequently, a negative voltage of the order of −300 V is applied to toner deposited on the surface of the developing roller 6. This will cause the toner on the developing roller 6 to be transferred only to portions of the photosensitive medium 2 from which the charge is removed by the radiation of the exposure beam **5*a* to perform the development in the so-called negative-positive process. The transfer roller 7 is applied with a high voltage of the order of +1 kV to transfer the toner deposited on the photosensitive medium 2 to the surface of the transfer sheet 10 transported by the feeding roller 12**.

When the transfer sheet 15 is manually inserted into the 5 manual paper feed inlet 14, it is transported to the transfer roller 7 according to rotation of the paper pickup roller 11 and the feeding roller 12, so that the toner deposited on the photosensitive medium 2 is transferred on the transfer sheet 15. The timing to start forming electrostatic latent images on the photosensitive medium 2 is, similar to the above, determined based on a signal provided by the registry arm 17.

When the second transfer sheet 27 is placed on the upper flat surface 30 of the casing 50 and the ejected paper tray 31 and then inserted into the second manual paper feed inlet 24 from the direction C, as shown in FIG. 2, it is directed by the guide 26 and the guide 25 to the paper pickup roller 11 and the feeding roller 12 and then fed to the transfer roller 7 so that the toner deposited on the photosensitive medium 2 is transferred on the transfer sheet 27. The unnecessary toner left on the photosensitive medium 2 without being transferred to the transfer sheet 10, 15, or 27 is removed by the cleaning blade 8.

The toner image-transferred transfer sheet 10, 15, or 27 is fed to the fixing device 18 wherein the toner images are fixed under heat applied by the heat roller 19 and pressure exerted by the pressure roller 20, after which it is directed by the selector member 21 to the face-up rollers 23 or the face-down rollers 22 according to a control signal.

Figure 3:
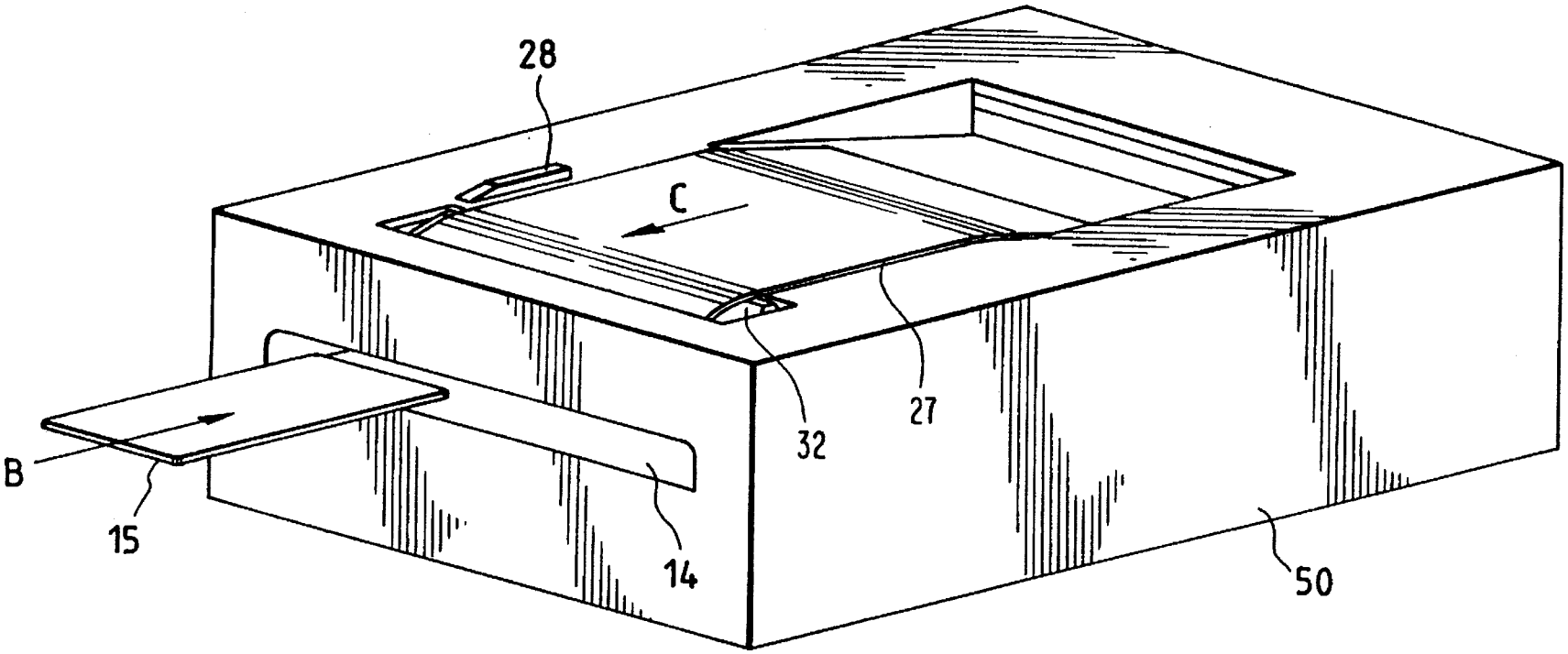
FIG. 3 is a perspective view which shows a second embodiment of an image forming apparatus according to the invention.
Figure 4:
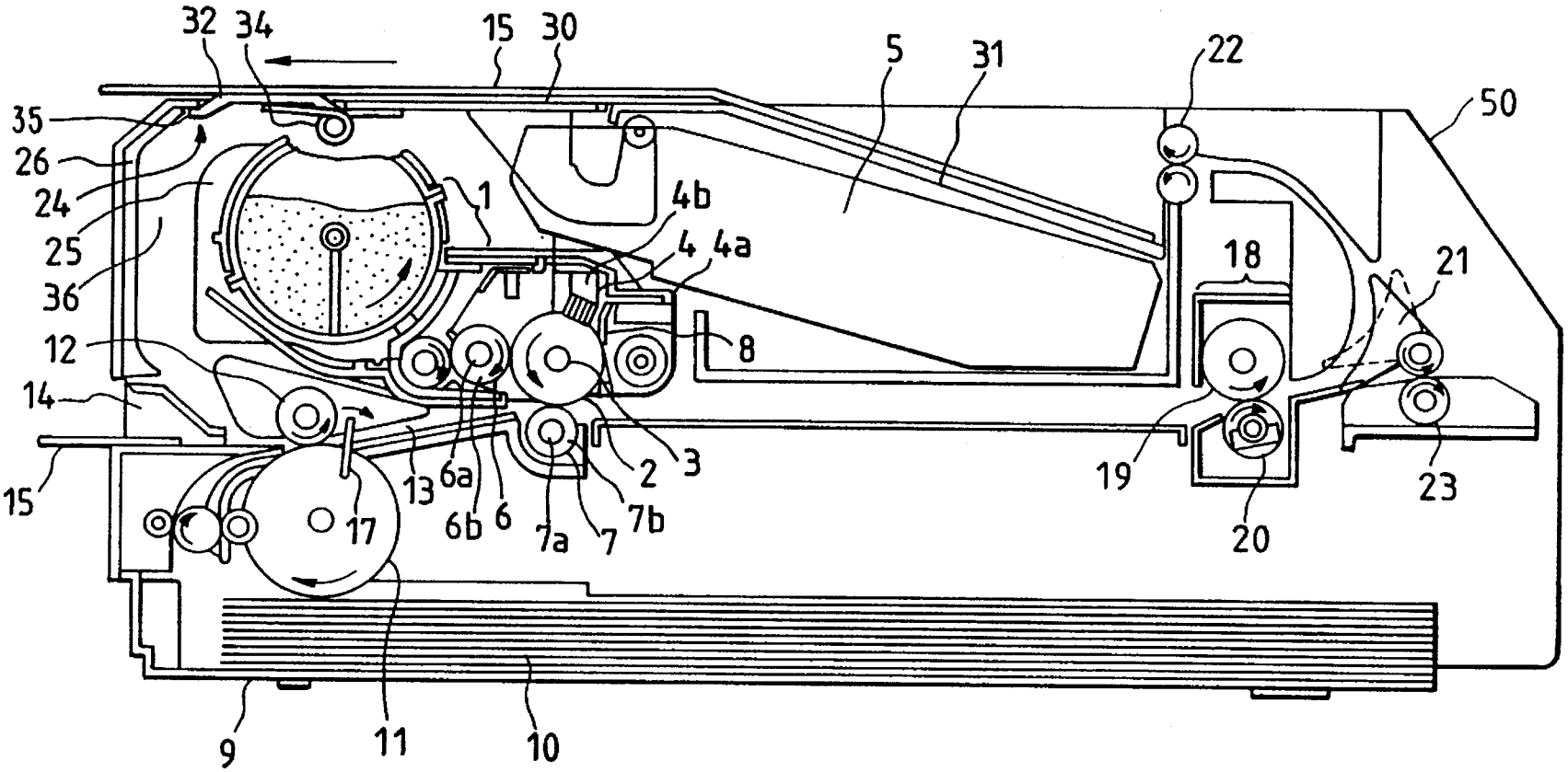
FIG. 4 is a cross sectional view which shows an image forming apparatus of the second embodiment.
Figure 5:
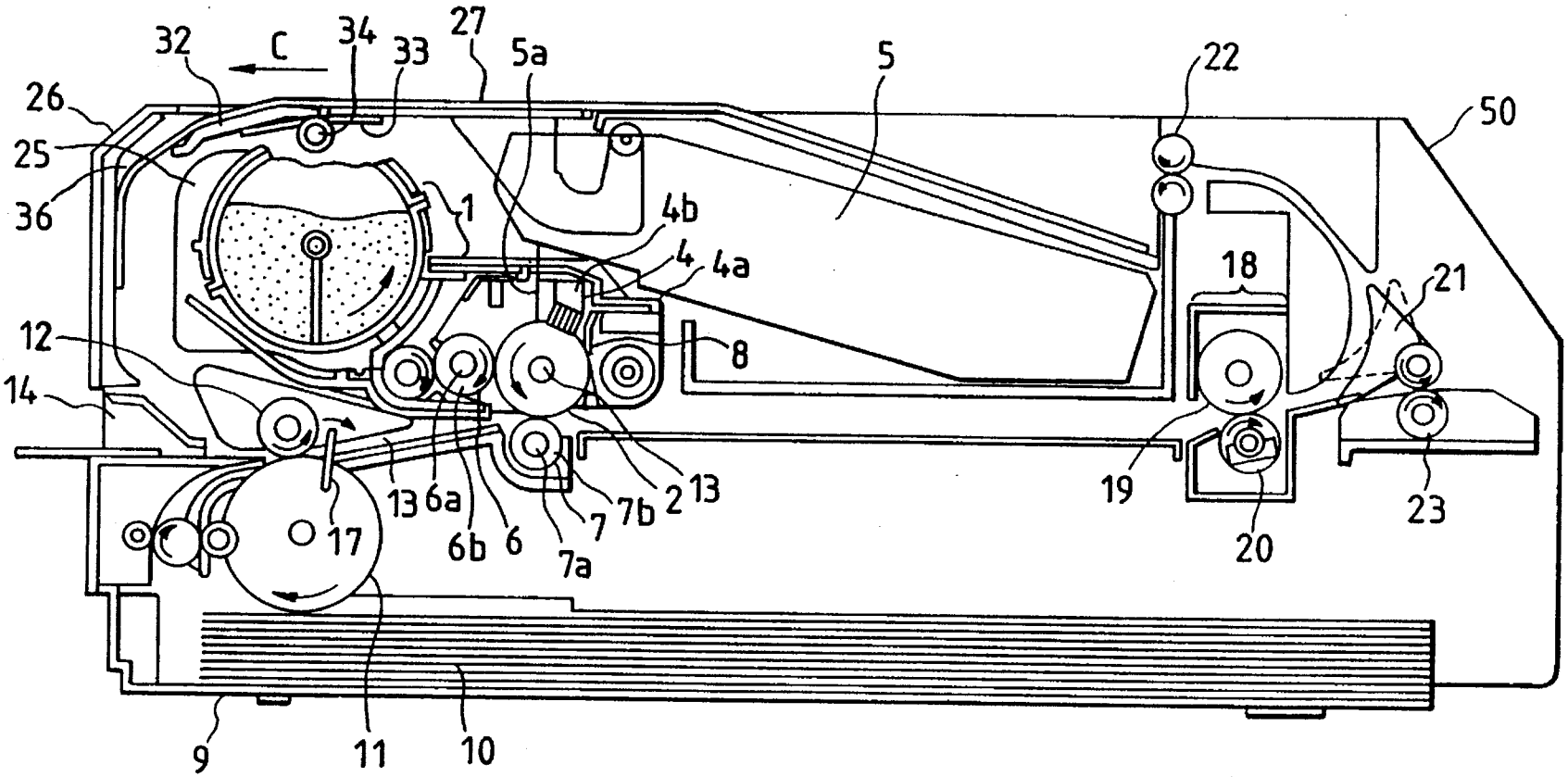
FIG. 5 is a cross sectional view which shows the image forming apparatus, as illustrated in FIG. 3, into which a transfer sheet is inserted through a manual paper feed inlet.
Figure 6:
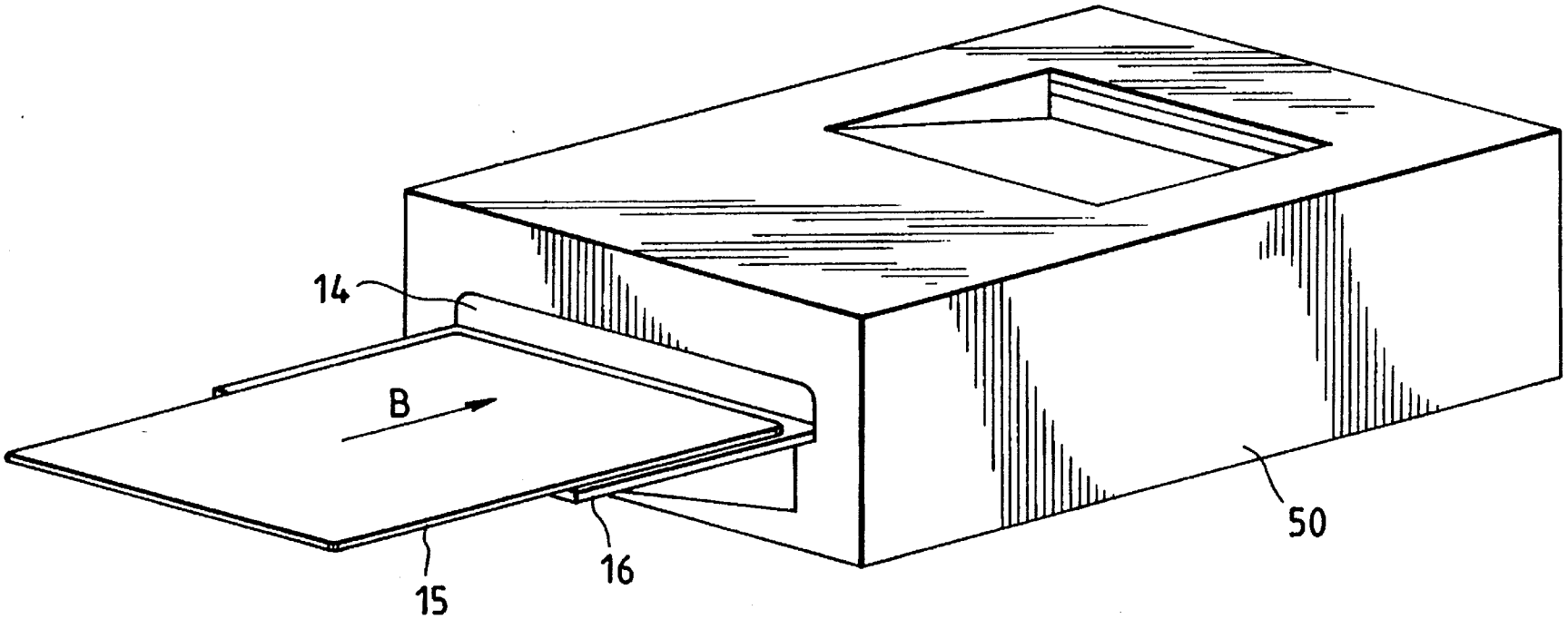
FIG. 6 PRIOR ART
FIG. 6 is a perspective view which shows a conventional image forming apparatus.
Figure 7:
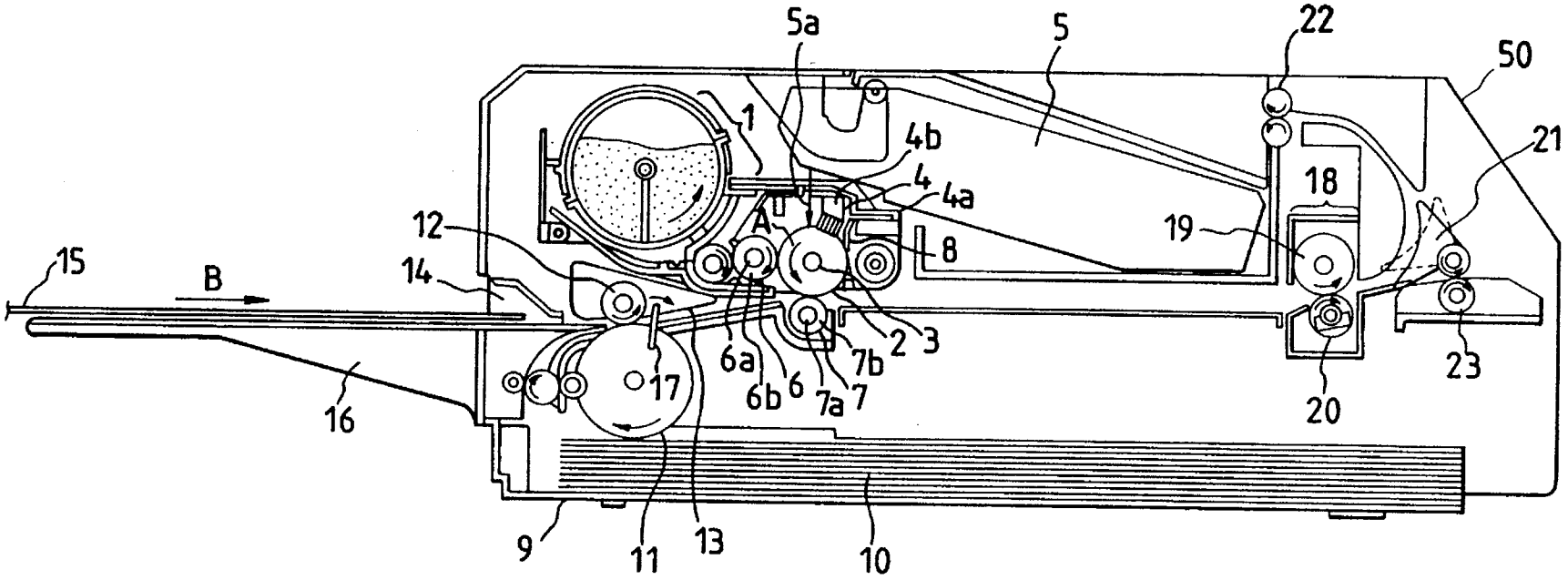
FIG. 7 PRIOR ART
FIG. 7 is a cross sectional view of the conventional image forming apparatus, as illustrated in FIG. 6.

Referring to FIGS. 3, 4, and 5, there is shown an alternative embodiment of the image forming apparatus according to the present invention. The same reference numbers as employed in the above first embodiment refer to same parts and explanation thereof in detail will be omitted here.

The image forming apparatus of this embodiment includes a cover 32 which is pivotably supported by a support shaft 34 to open the second manual paper feed inlet 24 and is urged upwardly by a spring, as viewed in FIG. 4, into constant engagement with an end portion 35 of an inner wall of the casing 50 to close the second manual paper feed inlet 24.

In operation, when the transfer sheet 10 or the hand-fed transfer sheet 15 is in use, the cover 32 is closed. Thus, when the transfer sheet 10 or 15 is ejected by the face-down rollers 22 in the direction C, the leading edge portion thereof passes over the cover 32 without entering the second manual paper feed inlet 24.

When the second transfer sheet 27 is manually fed into the second manual paper feed inlet 24, the operator first places it on the upper fiat surface 30 and the ejected paper tray 31 and then pushes the cover 32 downward to insert the second transfer sheet 27 into the second manual paper feed inlet 24 along the paper insertion guide 28 in the direction C. The second transfer sheet 27 then passes along the second transfer sheet feeding path 36 defined by the guides 25 and 26 and is transported by the feeding roller 12 and the paper pickup roller 11 toward the transfer roller 7 so that toner images formed on the photosensitive medium 2 are transferred by the transfer roller 7. Subsequently, the toner image-transferred second transfer sheet 27 is fed to the fixing device 18 wherein the toner images are fixed under heat applied by the heat roller 19 and pressure exerted by the pressure roller 20, and then transported to the face-up rollers 23 or face-down rollers 22 according to the position of the selector member 21.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An image forming apparatus comprising:

a casing having an upper surface;

image recording means disposed within said casing to record an image on a recording medium; and a recording medium feed inlet formed in the upper surface of said casing for insertion of the recording medium into said casing, wherein said casing has a flat surface formed on the upper surface leading to said recording medium feed inlet, and a guide member is further provided on the flat surface for guiding insertion of the recording medium into said recording medium feed inlet.

2. An image forming apparatus as set forth in claim 1, further comprising a second recording medium feed inlet formed in a side wall of said casing.

3. An image forming apparatus comprising:

a casing having an upper surface which has a first end portion and a second end portion opposite the first end portion, said casing having a flat surface formed on the upper surface;

image recording means disposed within said casing to record an image on a recording medium;

a recording medium ejection outlet formed in the first end portion of said casing for ejecting the recording medium on which the image is recorded by said image recording means out of said casing;

an ejected recording medium receiving portion formed on the upper surface of said casing between the first and second end portions for receiving the recording medium ejected from said recording medium ejection outlet;

a recording medium feed inlet formed in the second end portion of said casing, leading to the flat surface of said casing for insertion of the recording medium into said casing; and a guide member provided on the flat surface of said casing for guiding insertion of the recording medium into said recording medium feed inlet.

4. An image forming apparatus as set forth in claim 3, further comprising a cover provided on said recording medium feed inlet to selectively assume a closing position for closing said recording medium feed inlet and an opening position for opening said recording medium feed inlet.

5. An image forming apparatus as set forth in claim 3, further comprising a second recording medium feed inlet formed in a side wall of said casing.

6. An image forming apparatus comprising:

a casing having an upper surface which has a first end portion and a second end portion opposite the first end portion;

image recording means disposed within said casing to record an image on a recording medium;

a recording medium ejection outlet formed in the first end portion of said casing for ejecting the recording medium on which the image is recorded by said image recording means out of said casing;

an ejected recording medium receiving portion formed on the upper surface of said casing between the first and second end portions for receiving the recording medium ejected from said recording medium ejection outlet;

a recording medium feed inlet formed in the second end portion of said casing for insertion of the recording medium into said casing; and a cover provided on said recording medium feed inlet to selectively assume a closing position for closing said recording medium feed inlet and an opening position for opening said recording medium feed inlet, said cover being constantly urged by a spring to assume the closing position.

7. An image forming apparatus comprising:

a casing having an upper surface which has a first end portion and a second end portion opposite the first end portion, said casing having a flat surface formed on the upper surface;

image recording means disposed within said casing to record an image on a recording medium;

a recording medium ejection outlet formed in the first end portion of said casing for ejecting the recording medium on which the image is recorded by said image recording means out of said casing;

a recording medium feed inlet formed in the second end portion of said casing, leading to the flat surface of said casing for insertion of the recording medium into said casing; and a guide member provided on the flat surface of said casing for guiding insertion of the recording medium into said recording medium feed inlet.

8. An image forming apparatus as set forth in claim 7, further comprising a cover provided on said recording medium feed inlet to selectively assume a closing position for closing said recording medium feed inlet and an opening position for opening said recording medium feed inlet.

9. An image forming apparatus as set forth in claim 7, further comprising a second recording medium feed inlet formed in a side wall of said casing.

* * * * *